US008415895B2

(12) United States Patent
Hofmann et al.

(10) Patent No.: US 8,415,895 B2
(45) Date of Patent: Apr. 9, 2013

(54) LAMP COMPRISING A BASE AND AT LEAST ONE LIGHT-EMITTING SEMICONDUCTOR COMPONENT

(75) Inventors: Markus Hofmann, Bad Abbach (DE); Rainer Huber, Pentling (DE)

(73) Assignee: OSRAM Gesellschaft mit beschrankter Haftung, Munich (DE)

( * ) Notice: Subject to any disclaimer, the term of this patent is extended or adjusted under 35 U.S.C. 154(b) by 0 days.

(21) Appl. No.: 12/519,334

(22) PCT Filed: Dec. 12, 2007

(86) PCT No.: PCT/DE2007/002240

§ 371 (c)(1),
(2), (4) Date: Feb. 11, 2010

(87) PCT Pub. No.: WO2008/071178

PCT Pub. Date: Jun. 19, 2008

(65) Prior Publication Data

US 2010/0141144 A1 Jun. 10, 2010

(30) Foreign Application Priority Data

Dec. 15, 2006 (DE) ..... 20 2006 018 985

(51) Int. Cl.
*H05B 41/16* (2006.01)
*F21V 21/00* (2006.01)

(52) U.S. Cl.
USPC ..... 315/250; 362/84; 362/249.02

(58) Field of Classification Search ..... 315/246, 315/250; 362/84, 249.01, 249.02, 362
See application file for complete search history.

(56) References Cited

U.S. PATENT DOCUMENTS

| | | | | |
|---|---|---|---|---|
| 4,358,708 | A * | 11/1982 | Silva et al. | 315/58 |
| 4,630,183 | A | 12/1986 | Fujita | |
| 6,184,628 | B1 * | 2/2001 | Ruthenberg | 315/185 R |
| 6,474,837 | B1 | 11/2002 | Belliveau | |
| 6,621,716 | B2 * | 9/2003 | Edwards et al. | 361/803 |
| 2003/0185020 | A1 * | 10/2003 | Stekelenburg | 362/555 |
| 2009/0310383 | A1 * | 12/2009 | Chien | 362/644 |

FOREIGN PATENT DOCUMENTS

| | | |
|---|---|---|
| CA | 2 340 296 | 9/2002 |
| DE | 41 41 980 | 7/1993 |
| EP | 0 107 480 | 10/1983 |
| EP | 1 117 135 | 7/2001 |
| JP | 11 162209 | 6/1999 |
| JP | 2002 343104 | 11/2002 |
| JP | 2003-016806 | 1/2003 |
| JP | 2003-151306 | 5/2003 |
| JP | 2004-128408 | 4/2004 |
| JP | 2004-207043 | 7/2004 |
| JP | 2005-116182 | 4/2005 |
| WO | WO 2004/100213 | 11/2004 |

* cited by examiner

*Primary Examiner* — Don Le
(74) *Attorney, Agent, or Firm* — Cozen O'Connor

(57) ABSTRACT

A lamp with a base (1) and at least one light emitting semiconductor component (2) is disclosed. The base has at least two external electrical connections (11, 12) and at least two electrical connection parts (13, 14). The electrical connection parts are provided for electrically connecting the light emitting semiconductor component and are respectively connected to one of the external electrical connections in an electrically conducting manner. The light emitting semiconductor component is mounted on a carrier (3) and is electrically connected to at least two electrical contacting elements (31, 32), which are arranged and/or fixed on the carrier. Each of the electrical contacting elements is directly adjacent to one of the electrical connection parts and connected to it in an electrically conducting manner.

20 Claims, 2 Drawing Sheets

LAMP COMPRISING A BASE AND AT LEAST ONE LIGHT-EMITTING SEMICONDUCTOR COMPONENT

RELATED APPLICATIONS

This is a U.S. national stage under 35 USC §371 of application No. PCT/DE2007/002240, filed on Dec. 12, 2007.

This patent application claims the priority of the German utility patent application 202006018985.8, the disclosure content of which is hereby incorporated by reference.

BACKGROUND OF THE INVENTION

The present application relates to a lamp with a base and at least one light emitting semiconductor component.

Lamps based on light emitting semiconductor components are known from, for example, patent documents EP 1 594 170 A2 and WO 2004/100213 A2.

SUMMARY OF THE INVENTION

It is an object of the present invention to provide a lamp with a base and at least one light emitting semiconductor component that can be produced particularly simply and economically.

A lamp is disclosed having a base and at least one light emitting semiconductor component.

The light emitting semiconductor component is mounted on a carrier and connected to at least two electrical contacting elements, which are formed or fixed on the carrier.

The base comprises at least two external electrical connections, by means of which the lamp is supplied with an operating current in operation. Further, the base has at least two electrical connection parts, each of which is connected to one of the external electrical connections in an electrically conducting manner, and which are provided for electrically connecting the light emitting semiconductor component by means of the electrical contacting elements.

Each electrical contacting element of the base is directly adjacent to one of the electrical connection parts of the base and connected to it in an electrically conducting manner.

In an advantageous embodiment, at least one of the electrical contacting elements is constructed in the form of an electrical conductor track on the carrier. The carrier is preferably a circuit board, particularly a printed circuit board (PCB).

Preferably, at least one of the electrical contacting elements is welded to one of the electrical connection parts, or soldered or adhesively bonded to it by means of an electrically conducting material, for instance using a solder or an electrically conductive adhesive.

In an advantageous embodiment, at least one of the electrical connection parts passes through the carrier. In this way, a high mechanical stability is advantageously obtained. Moreover, in the manufacture of the lamp, by means of the electrical connection part passing through the carrier, a particularly simple and reproducible alignment of the carrier to the base is achieved, as well as a stable mechanical fixing of the carrier to the base.

For example, at least one of the electrical connection parts is constructed in the shape of a pin.

In another embodiment, one of the electrical contacting elements and/or one of the electrical connection parts is designed to be elastic, so that the contacting element and the connection part are pressed on to each other by means of a spring force. A mechanical and electrical contact is thus produced between the electrical contacting element and the electrical connection part.

For example, during the assembly of the lamp the carrier is arranged on or in the base in such a manner that, in doing so, the elastic electrical contacting element and/or the elastic electrical connection part are elastically deformed, and thus the spring force is produced that presses the contacting element and the connection part onto each other.

In this way an electrical contact between the light emitting semiconductor component and the external connection electrically connected to the electrical connection part is produced particularly simply during assembly.

The lamp is advantageously particularly simple to assemble. For example, in the manufacture of the lamp by means of a standard component mounting process, for instance a so-called "Pick and Place" process, the carrier is placed on or inserted into the base in a simple manner, and welded, soldered or adhesively bonded to it, as the case may be. Advantageously, no additional electrical contacting, for instance by means of connecting wires, is necessary.

In a further advantageous embodiment, the base is deformed for the purpose of fixing the carrier. For example, an edge region of the base is bent towards an edge region of a main surface of the carrier in order to fix the carrier. In an advantageous development of this embodiment, a first electrical connection part is deformed in such a way that it fixes the carrier and is connected in an electrically conducting manner to a first electrical contacting element.

For example, the edge region of the base represents the first electrical connection part and the first electrical contacting element is arranged on the edge region of the main surface of the carrier.

In the manufacture of the lamp the carrier is advantageously inserted into, or arranged on, the base and fixed to it in a quick and simple manner by deforming the base or a side wall of the base for example.

If after the deforming process the first electrical contacting element and the first electrical connection part are interconnected in an electrically conducting manner, for example if an edge region of a side wall of the base is bent on to an edge region of the main surface of the carrier, on which the first electrical contacting element is located, then due to the deformation of the base during the manufacture of the lamp the electrically conducting connection between the first electrical connection part and the first electrical contacting element is produced at the same time.

In one embodiment, the base has an opening and the carrier at least partially covers the opening, as seen in a plan view on to one of the main surfaces of the carrier. The base is, for example, a hollow body with an opening that lies opposite one of the external electrical connections, for example.

Here the carrier can be arranged either on an outer side of the base, or at least partially in an inner space of the base, preferably in an edge region of the hollow body adjacent to the opening.

In an alternative embodiment, the base is a solid body. A main surface of the carrier, for example, is facing a front side of the solid body.

In the case of a base which is a solid body, in an advantageous embodiment an electrically conducting part, having the first electrical connection part and the first external electrical connection, is injection molded, cast or pressed from behind—back-molded for short—with an injection molding compound, a casting compound, or a molding compound, referred to hereafter as a "molding compound". In a further advantageous embodiment, a further electrically conductive part having the second electrical connection part and the second external electrical connections, is alternatively or additionally overmolded, over-cast or over-pressed—in short "over-formed".

An over-formed electrically conductive part is preferably arranged largely within the molding compound. In particular only subregions, which represent the electrical connection part and the external electrical connection for example, project from the molding compound. On the other hand a back-molded electrically conductive part is arranged essentially outside the molding compound. However, it borders on the molding compound with at least one surface and is fixed to it in a mechanically stable way, for instance owing to interactions between the material of the molding compound and the material of the electrically conductive part and/or owing to the geometric configuration of the electrically conductive part, which has, for example, a toothing and/or another means of retention.

The base preferably has a central axis. The carrier is arranged, for example, parallel to the central axis, particularly inserted into the base, or arranged perpendicular, or at least essentially perpendicular, to the central axis. In one embodiment the central axis passes through at least of one the following components: carrier, light emitting semiconductor component, first electrical contacting element, second electrical contacting element, first electrical connection part, second electrical connection part, first external electrical connection, second external electrical connection.

In one embodiment the carrier has at least essentially the form of a circular area in plan view of its main plane of extension. In this embodiment the carrier can also have, for example at its periphery, at least one projection and/or at least one cutout so that it can be in particular aligned with respect to the base in a reproducible manner.

In one advantageous embodiment the base is a screw base. Preferably, one of the external electrical connections is constructed as a circumferential side wall of the base, in particular circumferential around the central axis, with a thread. For example, it is an Edison base with a standardized thread, particularly with an E14 or E27 thread. Alternatively the base can also be a bayonet base or a plug-type base.

In an advantageous embodiment, a driver circuit is arranged on the carrier for driving the light emitting semiconductor component. For example, the driver circuit is designed to rectify the operating voltage applied to the external electrical connections and to supply the light emitting semiconductor component with a suitable operating current.

BRIEF DESCRIPTION OF THE DRAWINGS

Further advantages and advantageous embodiments and developments of the lamp result from the following exemplary embodiments described in connection with FIGS. 1 to 4.

In the figures.

DETAILED DESCRIPTION OF THE DRAWINGS

In the exemplary embodiments and Figures, equivalent components, or components that have the same effect, are designated in each case with the same reference symbols. The elements illustrated and their proportions are certainly not to be regarded as true to scale; rather, individual elements, for example layers, can be represented in exaggerated size and/or thickness for better illustration and/or comprehension.

Figure 1:
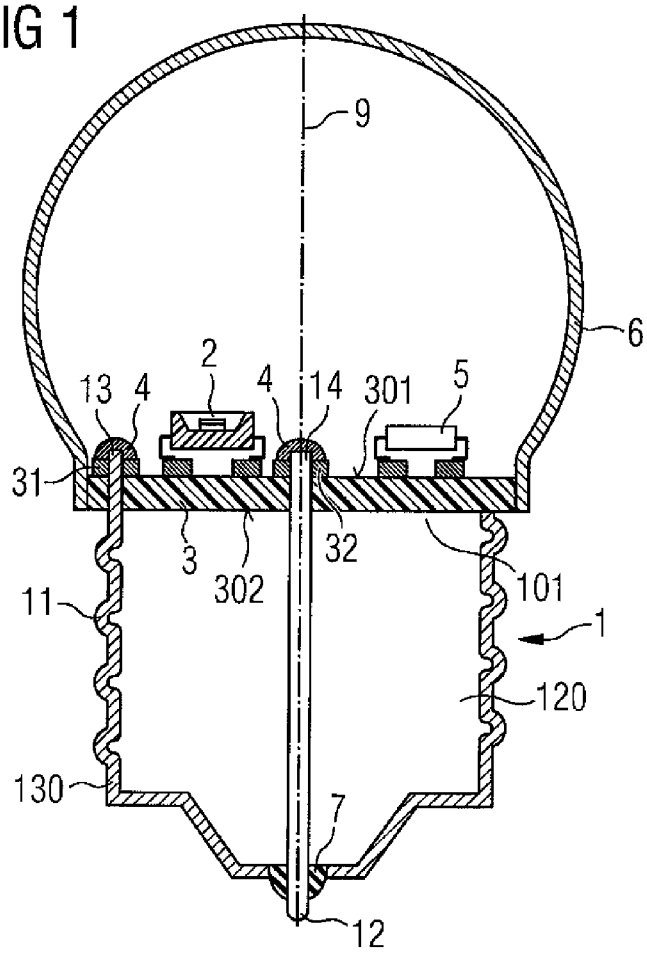
FIG. 1, shows a schematic sectional illustration of a lamp according to a first exemplary embodiment.

The lamp according to the first exemplary embodiment comprises a base 1, which is constructed in the form of a hollow body with an inner space 120 and has an opening 101 at its upper side (cf. FIG. 1).

The base is a screw base with a side wall 130, in the present case a metallic side wall, which is annularly circumferential around a central axis 9, and has a thread at the outside. The side wall represents a first electrical connection 11 of the base 1. The side wall 130 has, for example, one subregion facing away from the upper side, in which its cross-section decreases in a stepped fashion and/or continuously with increasing distance along the central axis away from the upper side. In this way, the side wall also preferably bounds the inner space 120 of the base at a bottom side opposite the upper side and the opening 101.

A first electrical connection part 13 is constructed in the form of a pin-shaped extension of the side wall 130 at the upper side of the base 1. A second electrical connection 12 is constructed at the bottom side. To this end, an electrically conducting pin, for example a metal pin, is pressed into an electrically insulating material 7, which is itself pressed in turn into a cut-out in the tapering subregion of the side wall 130. A part of the metal pin projects out of the insulating material 7 as a second electrical connection 12. The electrically conducting pin extends in the present case along the central axis 9 of the base 1 from the second electrical connection 12 towards the opening 101 and through the opening, and ends in a second electrical connection part 14.

By means of a standard component mounting process ("pick and place" process), a carrier 3, in this case a printed circuit board, is placed on the opening 101 of the base 1. The carrier 3 is arranged perpendicular to the central axis 9 of the base and covers the opening 101. For example, the carrier 3 projects laterally beyond the side wall 130.

The electrical connection parts 13, 14 extend parallel to the central axis 9 through the circuit board 3, in which cut-outs are provided for this purpose. Subregions of the conductor tracks are constructed as electrical contacting elements 31, 32 around these recesses on a first main surface 301 facing away from the base 1 of the circuit board 3.

The first electrical contacting element 31 is thus directly adjacent to the first electrical connection part 13 and the second electrical contacting element 32 directly adjacent to the second electrical connection part 14. In addition, the first electrical connection part 13 is connected to the first electrical contacting element 31 and the second electrical connection part 14 is connected to the second electrical contacting element 32 by means of an electrically conductive material 4, for example a solder metal such as AuSn or an electrically conducting adhesive, in a mechanically stable and electrically conducting manner.

Furthermore, a light emitting semiconductor component 2, for example a surface mountable light-emitting diode, and a driver circuit 5 are attached on the main surface 301 of the carrier 3 and electrically connected by means of the conductor tracks of the printed circuit board 3 in such a way that in operation, a suitable operating current is applied to the light emitting semiconductor component 2 by the electrical contacting elements 31, 32 by means of the driver circuit 5.

The driver circuit 5 can also alternatively be arranged on the second main surface 302 of the carrier 3, opposite to the first main surface 301, which second main surface is in the present case turned towards the inner space 120 of the base 1.

A cover 6 protects the light emitting semiconductor component 2 against mechanical damage and reduces the risk of the user touching voltage carrying parts of the lamp when the lamp is operating. In one embodiment, the cover 6 has a diffuser for light 2 emitted by the light emitting semiconductor component.

The cover 6 and the driver circuit 5 are not shown in the remaining exemplary embodiments to simplify the illustration.

Figure 2:
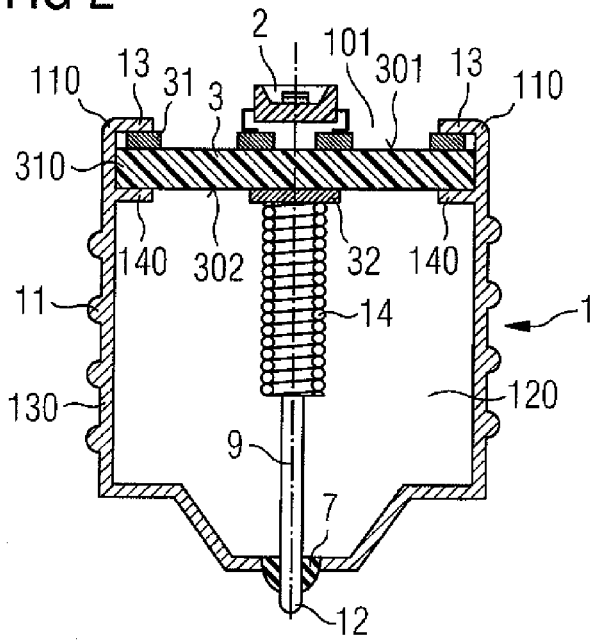
FIG. 2, shows a schematic sectional illustration of a lamp according to a second exemplary embodiment.

In the second exemplary embodiment of the lamp, illustrated in FIG. 2, the carrier 3 is arranged in the inner space 120 of the base 1. A subregion of the side wall 130 annularly surrounds the carrier 3 in plan view on to its first main surface 301. The carrier partially or completely covers the opening 101 in plan view on to its second main surface 302.

The carrier is fixed in the inner space 120 an edge region 110 of the side wall 130 being bent towards the central axis 9 and the first main surface 301 of the carrier. At least part of the edge region 110 of the side wall 130 of the base therefore extends at least essentially parallel to the first main surface 301 of the carrier 3, while another part, in particular a large part, of the side wall 130 extends essentially perpendicular to the main surface 301 of the carrier 3.

On an inner surface of the side wall 130, a retaining member 140 is formed, for example an annular circumferential projection or a plurality of projections, through which a common plane expediently extends, the plane being perpendicular to the central axis of the annular side wall 130. By means of the edge region 110 of the side wall and the retaining member 140, the carrier 3 is affixed to the base 1 in a mechanically stable manner.

In the present exemplary embodiment, the edge region 110 of the side wall 130 at the same time constitutes the first electrical connection part 13. It is directly adjacent to the first electrical contacting element 31, which in the present case is implemented as a conductor track that is arranged in an edge region 310 of the carrier 3 neighboring the edge region 110 of the side wall, in such a way that the subregion of the edge region 110 extending parallel to the first main surface 301 of the carrier and the conductor track 31 touch each other, due to which a mechanical and electrical contact is produced. In addition, the first electrical connection part 13 and the first electrical contacting element 31 can be welded, soldered by means of a solder, or adhesively bonded together by means of an electrically conducting adhesive.

The second electrical contacting element 32 in the lamp according to the second exemplary embodiment is constructed on the second main surface 302 of the carrier 3 facing the inner space 120 of the base.

The second electrical connection 12 is pin-shaped as in the exemplary embodiment according to FIG. 1. However, the pin is not brought as far as the carrier 3 as in the first exemplary embodiment. Instead, on its side facing away from the second external electrical connection 12, a spiral spring 14 is formed which forms the second electrical connection part. The pin with the spiral spring is preferably mounted in such a way that the central axes of 9 the pin, the spiral spring 14 and the circumferential side surface 130 coincide.

The length of the spiral spring 14 is dimensioned such that in the assembled condition of the lamp it is compressed by the carrier 3 which is fixed by means of the bent edge region 110 and the retaining member 140. Thus the end of the spring 14 facing away from the second external electrical connection 12 is pressed together with the second electrical contacting element 32 so that a mechanical and electrical contact is formed. In particular, the second electrical contacting element 32 is directly adjacent to the spring 14.

Figure 3:
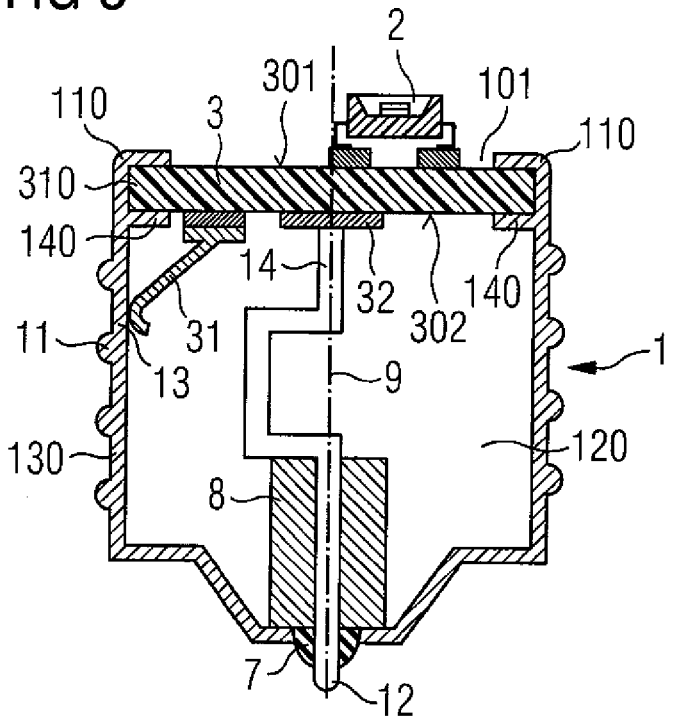
FIG. 3, shows a schematic sectional illustration of a lamp according to a third exemplary embodiment.

In the third exemplary embodiment of the lamp in accordance with FIG. 3 the carrier 3 is attached as in the preceding second exemplary embodiment. In this case however, in contrast to the second exemplary embodiment, the deformed edge region 110 does not form an electrical connection part, but rather only fixes the carrier 3 in the base 1 in a mechanically stable manner.

Alternatively to bending the edge region 110, as is illustrated in FIGS. 2 and 3, the fixing of the carrier 3 in the base can also be effected, for example, by means of a separate fixing element, constructed for instance in the form of an annular fixing element, and/or having at least one bracket. The fixing element is screwed on to or mounted on the side wall 130 of the base 1, for example in the edge region 110 adjacent to the opening 101.

In the third exemplary embodiment, the first contacting element is also arranged on the second main surface 302 of the carrier 3 along with the second contacting element 32. It extends from the second main surface 302 of the carrier towards the bottom side of the base 1 in its inner space 120. The first contacting element 31 has a sprung metal strip that is pressed on to an interior surface of the metallic side wall 130. In the present case, the side wall 130 therefore forms the first electrical connection part 13, which borders on the metal strip, and is thus directly adjacent to the first electrical contacting element 31 and electrically connected to it.

The electrical contacting of the second electrical contacting element 32 with the second electrical connection part 14 is also effected by means of a spring force, as in the second exemplary embodiment. In contrast to the second exemplary embodiment however, the second electrical connection part 14 is not bent to form a spiral spring. Instead both the second external electrical connection 12 and the second electrical connection part 14 are comprised of a metal pin, and are thus pin-shaped. In the area of the second external electrical connection 12 and the second electrical connection part 14, the metal pin extends, for example, on the central axis 9 of the base 1 or at least parallel or practically parallel thereto. In a central region between the second external electrical connection 12 and the second electrical connection part 14, the metal pin has a design, a U-shaped design for example, by means of which the second electrical connection part 14 can be elastically displaced.

The shape is preferably selected such that, when the carrier 3 is mounted, the second electrical connection part 14 abuts against the second electrical contacting element 32, in particular being pressed against this. For example, in the untensioned state of the metal pin the end 14 of the metal pin belonging to the second electrical connection part protrudes out of the inner space 120 of the base in the area of the opening 101, or it is arranged at a position which in the mounted condition of the lamp is occupied by the carrier 3 or the second electrical contacting element 32. In particular, the metal pin is then tensioned during the assembly of the carrier 3 and the second electrical connection part 14 is pressed against the second electrical contacting element 32.

For example in order to reduce the risk of damage to the second external electrical connection 12, and in particular to the electrically insulating material 7, due to the action of a force and/or a torque from the elastically tensioned metal pin, a stabilization body 8 is arranged between the deformation of the metal pin and the second external electrical connection 12, which, for example, at least partially transmits the force and/or the torque of the metal pin on to the tapering subregion of the side wall 130 at the bottom side of the base 1.

Figure 4:
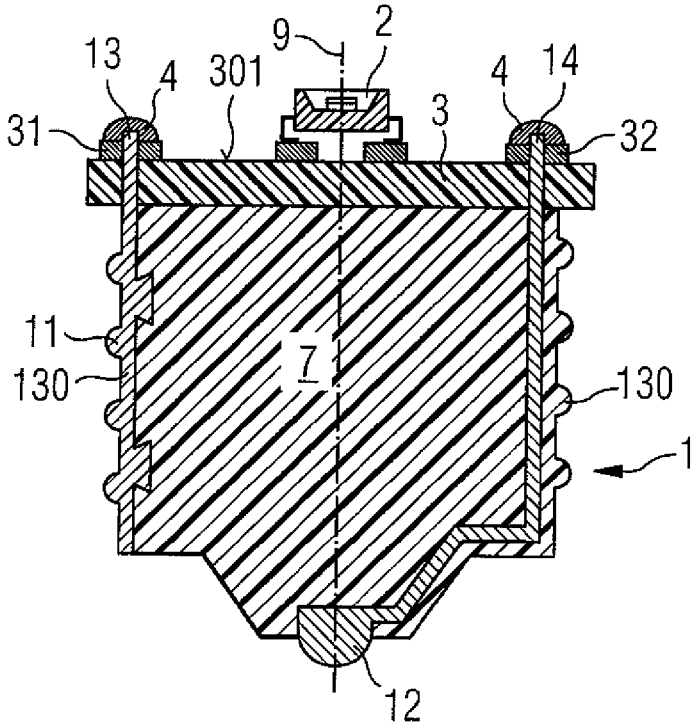
FIG. 4, shows a schematic sectional illustration of a lamp according to a fourth exemplary embodiment.

The base of the lamp according to the fourth exemplary embodiment shown in FIG. 4 is, in contrast to the previous exemplary embodiments, not a hollow body but a solid body. For example it has a base body that preferably contains an insulating material 7 or consists of one. The base body is preferably injection molded.

The first external electrical connection 11 is constructed in the present case on the base body, by a metal part being arranged on a side wall of the base body and being injection molded from behind with the electrically insulating material 7. On the rear side of the metal part facing away from the outer surface, for example, projections are arranged so that a particularly intimate connection is obtained in particular between the metal part, which has the first external electrical connection 11, and the injection molding compound 7.

Alternatively, the first external electrical connection 11 can also be produced, in a manner which is in principle known to the person skilled in the art, by activation of the injection molded base body, for instance by means of irradiation with laser radiation, and chemical deposition of a metal layer, for example by means of a galvanic deposition process.

The first electrical connection part 13 is constructed as a projection on the metal part that has the first external electrical connection 11. If the first external electrical connection 11 is applied chemically on to the injection molded base body, the latter preferably has the projection as the first electrical connection part 13. The projection is preferably pin-shaped. Particularly preferably it is arranged at the upper side of the base 1 and extends, analogously to the first exemplary embodiment, through the carrier 3 placed on the upper side of the base 1. At the upper side 301 of the carrier 3, also analogously to the first exemplary embodiment, it is directly adjacent to a conductor track of the carrier 3 constructed as a first electrical contacting element 31, and is electrically connected thereto.

The second external electrical connection 12 is arranged at a bottom side of the base 1 located opposite to the upper side. It is formed on a metal pin or metal strip that is injection molded into the base body. The second external electrical connection 12 forms a first, for example spherical segment-like portion of the metal pin or strip, which projects out of the base body, preferably in a central area of the bottom side of the base.

The second end of the metal pin or strip projects out of the injection molding compound at the upper side of the base, for example in an edge region of the upper side, and forms the second, preferably pin-shaped, electrical connection part 14. This too extends, analogously to the first exemplary embodiment, through the carrier 3 and, at the first main surface 301 of the carrier, which is facing away from the base 1, it is directly adjacent to a conductor track formed as a second electrical contacting element 32, and for example soldered, adhesively bonded or welded thereto.

The second main surface 302 of the carrier 3 and the upper side of the base are adjacent to one another and in particular abut against each other, or are, for example, adhesively bonded together by means of an adhesive layer.

The invention is not limited to the exemplary embodiments by the fact that the description is based on them. Rather, the invention comprises each new feature, as well as any combination of features, which includes in particular every combination of features in the patent claims, even if this feature or this combination itself is not explicitly specified in the patent claims or exemplary embodiments.

The invention claimed is:

1. A lamp comprising:

a base; and at least one light emitting semiconductor component;

wherein the base includes at least two external electrical connections and at least two electrical connection parts configured to electrically connect the light emitting semiconductor component and respectively connected to one of the external electrical connections in an electrically conducting manner;

wherein the light emitting semiconductor component is mounted on a carrier and is electrically connected to at least two electrical contacting elements, which are at least one of arranged on and attached to the carrier;

wherein each of the electrical contacting elements is directly adjacent to one of the electrical connection parts and connected thereto in an electrically conducting manner; and wherein at least one of one of the electrical contacting elements and one of the electrical connection parts is resilient so that a contacting element and a connection part are pressed on to each other by a spring force.

2. The lamp according to claim 1, wherein at least one of the electrical contacting elements is formed as an electrical conductor track on the carrier.

3. The lamp according to claim 1, wherein at least one of the electrical connection parts has a pin-shaped construction.

4. The lamp according to claim 1, wherein at least one of the electrical contacting elements is one of welded to one of the electrical connection parts, soldered and adhesively bonded thereto by means of an electrically conducting material.

5. The lamp according to claim 1, wherein at least one of the electrical connection parts extends through the carrier.

6. The lamp according to claim 1, wherein the base is deformed for fixing the carrier.

7. The lamp according to claim 6, wherein a first one of the electrical connection parts is deformed such that it is electrically connected to a first one of the electrical contacting elements.

8. The lamp according to claim 1, wherein the base includes a central axis which extends through the carrier.

9. The lamp according to claim 8, wherein a main plane of extension of the carrier is perpendicular to a central axis of the lamp.

10. The lamp according to claim 1, wherein the base includes an opening and the carrier at least partially covers the opening.

11. The lamp according to claim 1, wherein the base includes an inner space and the carrier is arranged within the inner space.

12. The lamp according to claim 1, wherein the base is a solid body.

13. The lamp according to claim 12, wherein an electrically conducting part, which comprises one of the electrical connection parts and one of the external electrical connections, is overmolded or back-molded with a molding compound.

14. The lamp according to claim 1, wherein the base is a screw base.

15. The lamp according to claim 14, wherein one of the external electrical connections is constructed as a circumferential side wall of the base with a thread.

16. The lamp according to claim 1, further comprising:

a driver circuit arranged on the carrier for driving the light emitting semiconductor component.

17. The lamp according to claim 1, wherein the carrier is formed as a circular area in a plan view of its main plane of extension.

18. A lamp comprising:

a base; and at least one light emitting semiconductor component;

wherein the base includes at least two external electrical connections and at least two electrical connection parts configured to electrically connect the light emitting semiconductor component and respectively connected to one of the external electrical connections in an electrically conducting manner;

wherein the light emitting semiconductor component is mounted on a carrier and is electrically connected to at least two electrical contacting elements, which are at least one of arranged on and attached to the carrier;

wherein the base is deformed for fixing the carrier;

wherein a first one of the electrical connection parts is deformed such that it is electrically connected to a first one of the electrical contacting elements; and wherein an edge region of the base is bent towards an edge region of a main surface of the carrier.

19. The lamp according to claim 18, wherein the edge region of the base forms the first electrical connection part and the first electrical contacting element is arranged on the edge region of the main surface of the carrier.

20. A lamp comprising:

a base; and at least one light emitting semiconductor component;

wherein the base includes at least two external electrical connections and at least two electrical connection parts configured to electrically connect the light emitting semiconductor component and respectively connected to one of the external electrical connections in an electrically conducting manner;

wherein the light emitting semiconductor component is mounted on a carrier and is electrically connected to at least two electrical contacting elements, which are at least one of arranged on and attached to the carrier;

wherein each of the electrical contacting elements is directly adjacent to one of the electrical connection parts and connected thereto in an electrically conducting manner; and wherein one of the electrical connection parts is constructed in a pin-shaped extension of a side wall at an upper side of the base.

* * * * *